US011464367B2

(12) United States Patent
Albert et al.

(10) Patent No.: US 11,464,367 B2
(45) Date of Patent: Oct. 11, 2022

(54) FLUID APPLICATION SYSTEM WITH INTEGRAL DISPENSING TUBE

(71) Applicant: Tactopack, Inc., Pelham, NY (US)

(72) Inventors: Jonathan D. Albert, Philadelphia, PA (US); Steven Bank, Pelham, NY (US)

(73) Assignee: TACTOPACK, INC., Pelham, NY (US)

( * ) Notice: Subject to any disclaimer, the term of this patent is extended or adjusted under 35 U.S.C. 154(b) by 0 days.

(21) Appl. No.: 17/229,011

(22) Filed: Apr. 13, 2021

(65) Prior Publication Data

US 2021/0315425 A1 Oct. 14, 2021

Related U.S. Application Data

(60) Provisional application No. 63/009,221, filed on Apr. 13, 2020.

(51) Int. Cl.
*A47K 5/12* (2006.01)
*A41D 19/00* (2006.01)
*B65D 83/00* (2006.01)

(52) U.S. Cl.
CPC ..... *A47K 5/1201* (2013.01); *A41D 19/0024* (2013.01); *B65D 83/0094* (2013.01)

(58) Field of Classification Search
CPC ..... A46B 5/04; A47K 5/1201; A47K 7/03; A47K 13/18; A47L 13/19; B05B 7/1413
USPC ..... 222/175, 207, 209
See application file for complete search history.

(56) References Cited

U.S. PATENT DOCUMENTS

| | | | |
|---|---|---|---|
| 19,188 | A | 1/1858 | Evans |
| 674,913 | A | 5/1901 | Fike |
| 685,574 | A | 10/1901 | Conboie |
| 722,863 | A | 3/1903 | Lodge |
| 836,181 | A | 11/1906 | Cray |
| 877,628 | A | 1/1908 | Benson |
| 1,161,719 | A | 11/1915 | Norton |
| 1,438,485 | A | 12/1922 | Goldberg |

(Continued)

FOREIGN PATENT DOCUMENTS

| | | | |
|---|---|---|---|
| CH | 303374 | A | 11/1954 |
| EP | 2676544 | A1 | 12/2013 |

(Continued)

*Primary Examiner* — Vishal Pancholi
*Assistant Examiner* — Robert K Nichols, II
(74) *Attorney, Agent, or Firm* — Leason Ellis LLP

(57) ABSTRACT

A portable fluid dispensing device (system) for mounting upon a human hand and for dispensing a fluid is provided. The device includes a hand-held applicator that includes a pocket that is configured to receive one hand of a user. The pocket partitions the hand-held applicator into a rear portion and a front portion. The rear portion includes a fluid reservoir for holding a fluid that is to be dispensed. The front portion is defined by a foam layer that has a dispensing hole, with the pocket being defined between the rear portion and the foam layer. The device further includes a pump subassembly that is in fluid communication with the fluid reservoir and includes an elongated fluid dispensing outlet that is disposed within the pocket and attached to an inner surface of the foam layer. The fluid dispensing outlet defines a fluid channel and includes an outlet that is aligned with the dispensing hole for delivering the fluid to an outer surface of the foam layer.

16 Claims, 5 Drawing Sheets

(56) References Cited

U.S. PATENT DOCUMENTS

| | | | |
|---|---|---|---|
| 1,481,772 | A | 1/1924 | Zell |
| 1,533,732 | A | 4/1925 | Livingstone |
| 1,558,930 | A | 10/1925 | Schuck |
| 1,619,180 | A | 3/1927 | Andrew |
| 1,713,065 | A | 5/1929 | Williams |
| 1,941,320 | A | 12/1933 | Pamplin |
| 2,075,413 | A | 3/1937 | Logue |
| 2,405,154 | A | 8/1946 | Logan |
| 2,562,418 | A | 7/1951 | Enrico et al. |
| 2,651,071 | A | 9/1953 | Frances et al. |
| 2,722,706 | A | 11/1955 | Joan |
| 2,795,806 | A | 6/1957 | Omar |
| 2,831,206 | A | 4/1958 | Curtis |
| 3,116,732 | A | 1/1964 | Cahill |
| 3,485,562 | A | 12/1969 | Hidden et al. |
| 3,589,819 | A | 6/1971 | Bryant |
| 3,701,604 | A | 10/1972 | Holroyd |
| 3,778,172 | A | 12/1973 | Myren |
| 3,883,897 | A | 5/1975 | Lefkowitz et al. |
| 3,885,249 | A | 5/1975 | De Brabander |
| 4,037,790 | A | 7/1977 | Reiser et al. |
| 4,088,127 | A | 5/1978 | Clayton |
| 4,101,057 | A | 7/1978 | LoMaglio |
| 4,156,493 | A | 5/1979 | Julius |
| 4,349,288 | A | 9/1982 | Bond |
| 4,411,652 | A | 10/1983 | Kramer |
| 4,457,640 | A | 7/1984 | Anderson |
| 4,602,650 | A | 7/1986 | Pipkin |
| 4,645,251 | A | 2/1987 | Jacobs |
| D290,777 | S | 7/1987 | Lee |
| 4,766,914 | A | 8/1988 | Briggs |
| 4,805,242 | A | 2/1989 | Bolton |
| 4,882,978 | A | 11/1989 | Bruggeman |
| 4,953,998 | A | 9/1990 | McCartherens |
| 4,959,881 | A | 10/1990 | Murray |
| 4,961,508 | A | 10/1990 | Welmer |
| 5,094,559 | A | 3/1992 | Rivera et al. |
| 5,111,934 | A | 5/1992 | Morin |
| 5,120,304 | A | 6/1992 | Sasaki |
| 5,169,251 | A | 12/1992 | Davis |
| 5,441,355 | A | 8/1995 | Moore |
| 5,456,354 | A | 10/1995 | Wood |
| 5,473,789 | A | 12/1995 | Oster |
| 5,542,566 | A | 8/1996 | Glaug et al. |
| 5,584,667 | A | 12/1996 | Davis |
| 5,722,349 | A | 3/1998 | Wolgamuth |
| 5,732,716 | A | 3/1998 | Utecht |
| 5,806,668 | A | 9/1998 | Bixby |
| 5,867,829 | A | 2/1999 | Hegoas et al. |
| 5,947,275 | A | 9/1999 | Hess |
| 5,956,770 | A | 9/1999 | Dennis |
| 6,098,234 | A | 8/2000 | Jackson, Jr. |
| 6,145,155 | A | 11/2000 | James et al. |
| 6,168,019 | B1 | 1/2001 | Olson |
| 6,257,785 | B1 | 7/2001 | Otten |
| 6,280,529 | B1 | 8/2001 | Meyer |
| 6,305,044 | B1 | 10/2001 | James et al. |
| 6,508,602 | B1 | 1/2003 | Gruenbacher et al. |
| 6,513,998 | B1 | 2/2003 | Barry |
| 6,539,549 | B1 | 4/2003 | Peters, Jr. |
| 6,547,468 | B2 | 4/2003 | Gruenbacher et al. |
| 6,554,134 | B1 | 4/2003 | Guibert |
| 6,557,178 | B1 | 5/2003 | Hoover |
| 6,588,961 | B2 | 7/2003 | Lafosse-marin et al. |
| 6,604,244 | B1 | 8/2003 | Leach |
| 6,669,387 | B2 | 12/2003 | Gruenbacher et al. |
| 6,726,386 | B1 | 4/2004 | Gruenbacher et al. |
| 6,811,338 | B1 | 11/2004 | Manske, Jr. et al. |
| 6,817,801 | B1 | 11/2004 | Colburn et al. |
| 6,834,619 | B1 | 12/2004 | Rampersad |
| 7,021,848 | B1 | 4/2006 | Gruenbacher et al. |
| 7,033,100 | B2 | 4/2006 | Barton et al. |
| 7,108,440 | B1 | 9/2006 | Gruenbacher et al. |
| 7,179,007 | B2 | 2/2007 | Wong et al. |
| 7,255,506 | B2 | 8/2007 | Gruenbacher et al. |
| 7,478,768 | B2 | 1/2009 | Yip |
| 7,604,623 | B2 | 10/2009 | Brunner et al. |
| 7,730,574 | B1 | 6/2010 | Cox, Sr. |
| 7,731,056 | B2 | 6/2010 | Tramontina |
| 7,823,245 | B2 | 11/2010 | Firouzman |
| 7,874,020 | B1 | 1/2011 | Franklin |
| 7,904,969 | B2 | 3/2011 | Greenfield |
| 8,061,558 | B2 | 11/2011 | Jordan et al. |
| 8,069,526 | B2 | 12/2011 | Malaska |
| 8,167,177 | B1 | 5/2012 | Galgano |
| 8,196,746 | B2 | 6/2012 | Storandt |
| 8,230,523 | B2 | 7/2012 | Chareyron |
| 8,262,305 | B2 | 9/2012 | Lam et al. |
| 8,356,378 | B1 | 1/2013 | Crooms |
| 8,661,601 | B2 | 3/2014 | Klingbeil |
| 8,689,387 | B2 | 4/2014 | Gundersen |
| 8,794,189 | B1 | 8/2014 | Dahlquist et al. |
| 8,826,467 | B2 | 9/2014 | Chew et al. |
| 9,326,645 | B1 | 5/2016 | Bank et al. |
| 9,808,130 | B2 | 11/2017 | Bank et al. |
| 10,039,424 | B2 | 8/2018 | Bank et al. |
| 10,219,657 | B2 | 3/2019 | Albert et al. |
| 10,617,264 | B1 * | 4/2020 | Sookdeo ..... A47K 7/03 |
| 2002/0118993 | A1 | 8/2002 | Lafosse-Marin et al. |
| 2003/0192105 | A1 | 10/2003 | Lin |
| 2005/0217045 | A1 | 10/2005 | Minkler et al. |
| 2006/0064830 | A1 | 3/2006 | Sigl |
| 2006/0230559 | A1 | 10/2006 | Knopow |
| 2006/0288954 | A1 | 12/2006 | Graunstadt |
| 2007/0094766 | A1 | 5/2007 | Liu |
| 2007/0130707 | A1 | 6/2007 | Cohen et al. |
| 2007/0192975 | A1 | 8/2007 | Aseff |
| 2007/0206984 | A1 | 9/2007 | Fagel et al. |
| 2008/0078046 | A1 | 4/2008 | Reed |
| 2008/0276395 | A1 | 11/2008 | Powell et al. |
| 2009/0257303 | A1 | 10/2009 | Rayner et al. |
| 2010/0037413 | A1 | 2/2010 | Tyler |
| 2010/0218326 | A1 | 9/2010 | Yamaguchi |
| 2010/0257681 | A1 | 10/2010 | Lin |
| 2011/0113528 | A1 | 5/2011 | Chew et al. |
| 2011/0240760 | A1 | 10/2011 | Tucker |
| 2011/0274377 | A1 | 11/2011 | Lin |
| 2012/0051828 | A1 | 3/2012 | Gundersen |
| 2012/0090121 | A1 | 4/2012 | Phillips, Sr. et al. |
| 2012/0189371 | A1 | 7/2012 | Morelli |
| 2013/0341212 | A1 | 12/2013 | Perelli |
| 2014/0367422 | A1 | 12/2014 | Brennow |
| 2016/0000293 | A1 | 1/2016 | Povitz |
| 2016/0287032 | A1 | 10/2016 | Bank et al. |
| 2017/0045045 | A1 | 2/2017 | Tseng |
| 2017/0202422 | A1 | 7/2017 | Hagen |
| 2017/0238770 | A1 | 8/2017 | Albert et al. |
| 2019/0075981 | A1 | 3/2019 | Albert et al. |
| 2019/0261819 | A1 | 8/2019 | Albert |

FOREIGN PATENT DOCUMENTS

| | | | |
|---|---|---|---|
| FR | 1127965 | A | 12/1956 |
| FR | 1539481 | A | 9/1968 |
| GB | 924503 | A | 4/1963 |
| JP | 2001269222 | A | 10/2001 |
| WO | WO 2004/100735 | | 11/2004 |
| WO | WO 2006120330 | | 11/2006 |
| WO | WO 2007122594 | | 11/2007 |
| WO | WO 2008096135 | | 8/2008 |

* cited by examiner

FLUID APPLICATION SYSTEM WITH INTEGRAL DISPENSING TUBE

CROSS-REFERENCE TO RELATED APPLICATIONS

The present application claims priority to and the benefit of U.S. patent application Ser. No. 63/009,221, filed Apr. 13, 2020, which is hereby incorporated by reference in its entirety.

The present application is related to the following applications and patents that have the same Applicant as in the present application: U.S. Pat. No. 9,326,645; U.S. Pat. No. 10,219,657; U.S. Pat. No. 10,039,424; U.S. Pat. No. 9,808,130; U.S. patent application publication No. 2009/0257303; and U.S. patent application publication No. 2019/0075981, each of which is hereby incorporated by reference in its entirety.

TECHNICAL FIELD

The present invention relates to the area of products used in the act of dispensing a fluid. It also relates to the area of mitts or gloves used in a fluid application process. More particularly, it relates to hand-worn articles in which a material is supplied in a fluid state to assist in a cleaning or application operation. The present invention additionally relates to the packaging, display, and storage of such articles. As described in the above-incorporated documents, the applicator can be used in a personal cleaning application in which a fluid is applied onto the skin of the user to perform a certain task, such as cleaning the skin or applying a product to the skin, such as a sunscreen product. Also, the present applicator can dispense a fluid for non-personal use, such as car care products which can be dispensed onto a car surface, such as a leather seat. The fluid can thus be a leather conditioner that can be applied to the leather seat. Other fluids to be dispensed can be cleaning products for inanimate object, such as windows, floors, etc.

BACKGROUND

The convenience of combining a hand-mounted device with a brushing, cleaning, wiping, polishing, or material application function may be generally appreciated as such wearable products free the user from the necessity of actively gripping a cloth, sponge, or other loose material.

A number of attempts have been made to produce such hand-mounted devices. For example, U.S. Pat. No. 19,188 to Evans shows a flexible hand-mounted curry comb for use in the grooming of livestock. U.S. Pat. No. 674,913 to Fike shows a hand-mounted glove with an internal pocket devised to hold soap or medicated material, so that the glove may be dipped in water to activate the enclosed material. U.S. Pat. No. 722,863 to Lodge discloses a cleaning mitt in which a stack of facing layers may be successively exposed.

U.S. Pat. No. 836,181 to Cray reveals a washing glove with an external fluid supply line and an integral fluid reservoir. U.S. Pat. No. 1,161,719 to Norton details a hand-worn device with integrated, perforated reservoirs from which fluid materials may be actively and electively expressed. U.S. Pat. No. 3,116,732 to Cahill describes a disposable glove with rupturable reservoirs carrying lotion, liquid or balm. U.S. Pat. No. 4,959,881 to Murray provides for a disposable cleaning mitt with an initially sealed container holding a pad permeated with a cleaning solution.

U.S. Pat. No. 3,778,172 to Myren illustrates a cleaning glove with a reservoir refillable through a valve. U.S. Pat. No. 5,169,251 to Davis shows a hand-worn dispenser with fingertip applicators that may be individually opened or capped to regulate the dispensing pattern. U.S. Pat. No. 6,145,155 discloses a sealed disposable mitt with a moistened face and a drying face. U.S. Pat. No. 6,257,785 to Otten et al. depicts a glove with a plurality of individual reservoirs arranged in a dimpled relief pattern so that a degree of user control is allowed over the amount and location of the encapsulated agent that is released.

By reference to the examples above, it may be generally understood that there has been a longstanding interest in systems which integrate a hand-worn article with consumable cleaning materials. It may also be appreciated that the inclusion of a fluid carrier within a hand-worn article, whether for water of other liquid formulation, can enhance the utility and convenience of such a device.

SUMMARY

In one embodiment, a portable fluid dispensing device (system) for mounting upon a human hand and for dispensing a fluid is provided. The device includes a hand-held applicator that includes a pocket that is configured to receive one hand of a user. The pocket partitions the hand-held applicator into a rear portion and a front portion. The rear portion includes a fluid reservoir for holding a fluid that is to be dispensed and the rear portion includes a first layer and a second layer that are fluidly sealed to one another such that the fluid reservoir is formed between the first and second layers. The front portion is defined by a foam layer that has a dispensing hole, with the pocket being defined between the second layer and the foam layer. The device further includes a pump subassembly that is in fluid communication with the fluid reservoir and includes an elongated fluid dispensing outlet that is disposed within the pocket and attached to an inner surface of the foam layer. The fluid dispensing outlet defines a fluid channel and includes an outlet that is aligned with the dispensing hole for delivering the fluid to an outer surface of the foam layer.

BRIEF DESCRIPTION OF DRAWING FIGURES

DETAILED DESCRIPTION OF CERTAIN EMBODIMENTS

FIGS. 1-6 illustrate a fluid application system (fluid applicator) 100 that includes an integral dispensing tube 250 that is described in detail below and is configured to dispense the fluid to a dispensing surface of the fluid applicator. Generally, the fluid applicator 100 can take the form of a mitt or glove into which the hand is inserted with one surface of the mitt representing a dispensing surface from which the fluid is dispensed. The mitt structure includes a pouch comprising at least two layers of impermeable material so that a fluid reservoir may be provided at a location corresponding to the back of the hand. A pump subassembly, which is devised to momentarily capture a metered amount of fluid from the reservoir, is located in an unobtrusive location, such as a corner of the mitt.

Figure 2:
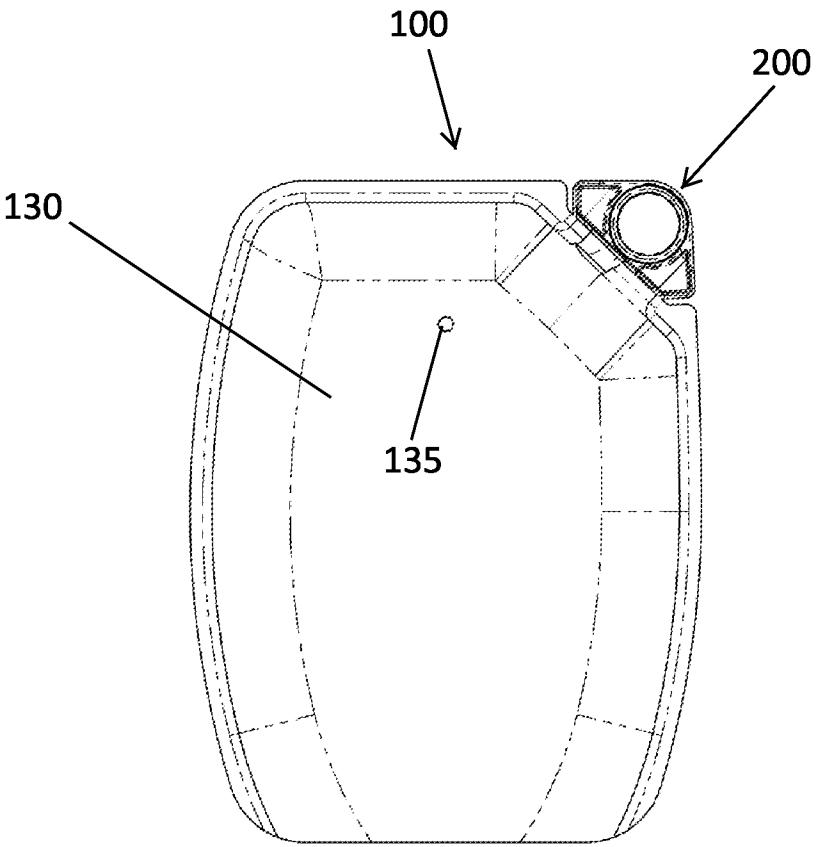
FIG. 2 is a bottom plan view thereof.
Figure 1:
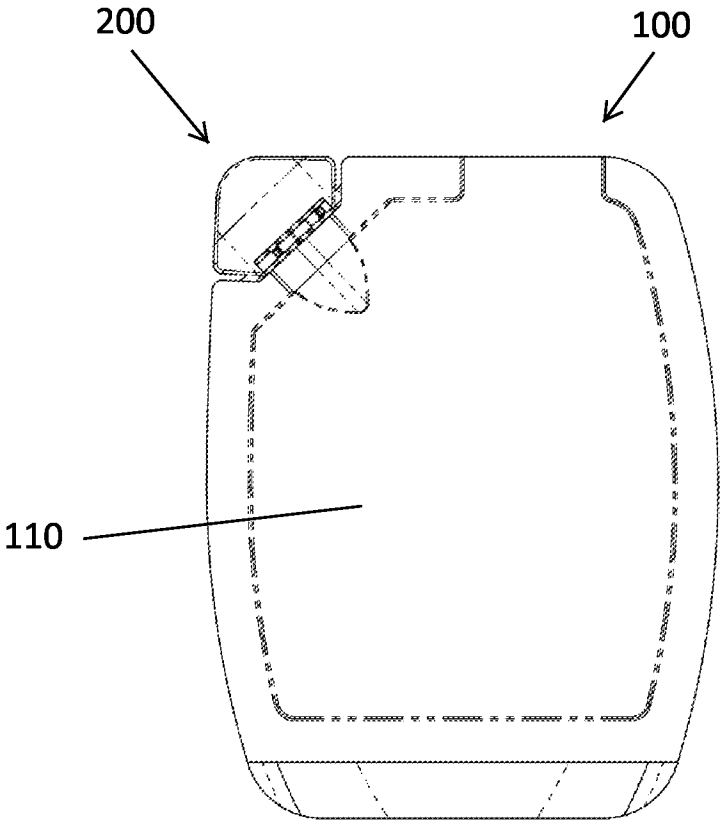
FIG. 1 is a top plan view of a fluid application system.

FIG. 1 is a top plan view of the fluid application system 100 illustrating a first (top) face, while FIG. 2 is a bottom plan view of the fluid application system 100 illustrates a second (bottom) face that represents a dispensing face of the system 100. As shown, a pump subassembly 200 is provided within the fluid application system 100 and more specifically, the pump subassembly 200 is located within one corner of the fluid application system 100.

Figure 3:
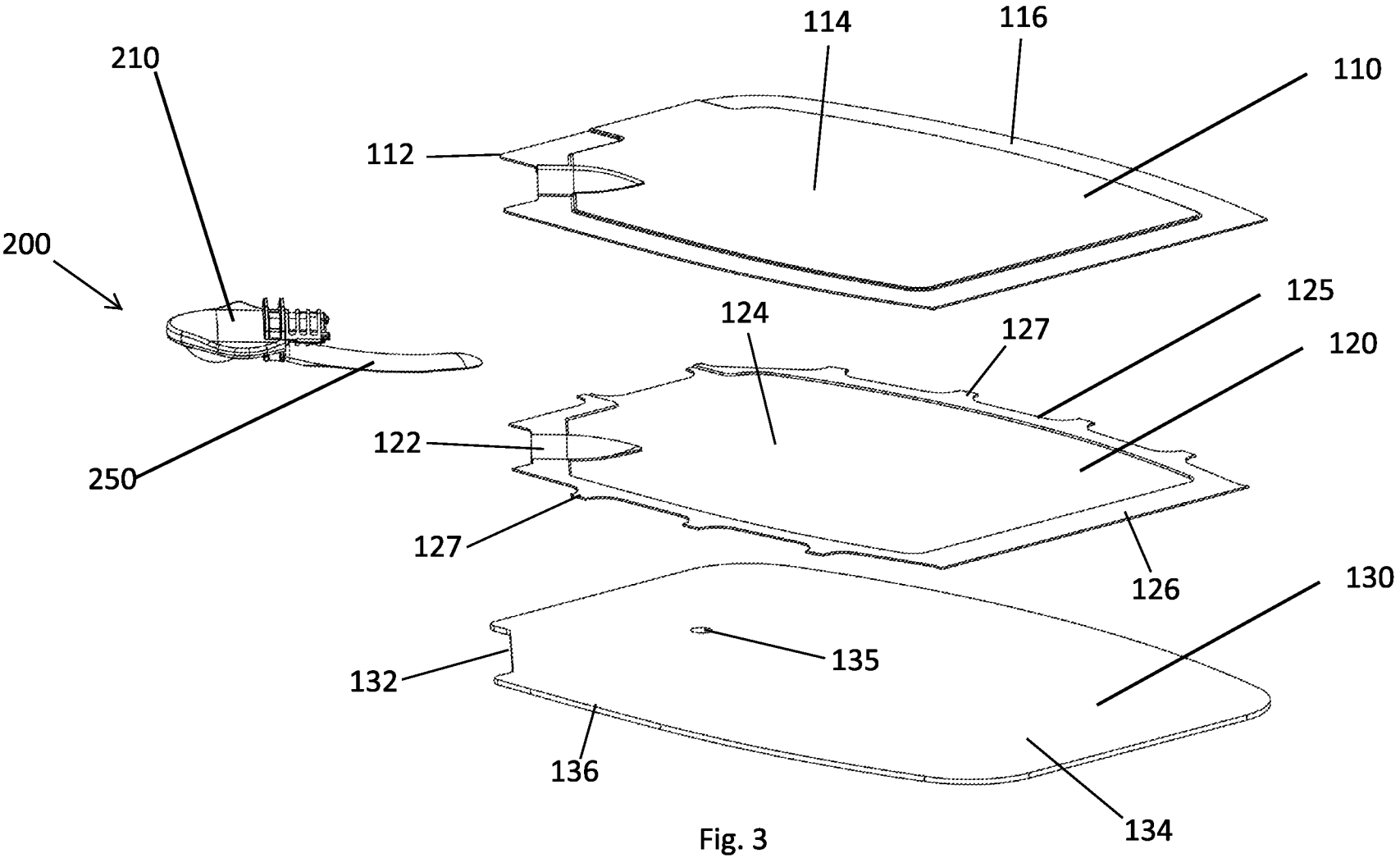
FIG. 3 is an exploded perspective of the fluid application system.

As shown in FIG. 3, the fluid application system 100 includes a first layer (top layer) 110, a second layer (bottom layer) 120, and a third layer (foam layer) 130.

The first layer 110, which represents the top layer, has a first corner 112 that is configured to receive and accommodate the pump subassembly 200. The first layer 110 includes an inner section 114 and a peripheral section 116 that surrounds the inner section 114. The first layer 110 is formed of a fluid impermeable material, such as one of those recited in one of Applicant's previous patents or patent applications mentioned herein. The first layer 110 has an inner surface or face that faces the second layer 120 and opposite outer surface or face that faces outwardly.

The second layer 120, which represents the bottom layer, has a first corner 122 that is superimposed with the first corner 112 of the first layer 110. The second layer 120 has an inner surface or face that faces the first layer 110 and opposite outer surface or face that faces away from the first layer 110.

The second layer 120 includes an inner section 124 and a peripheral section 126 that surrounds the inner section 124. Within the peripheral section 126 there are a plurality of cutouts or notches 125 that are cut into the peripheral section 126. Between a pair of adjacent notches 125 is a peak portion 127. The notches 125 can be formed to have any number of different shapes including the illustrated shape which is defined by a flat floor and a pair of curved sides that partially define the peak portion 127. As shown, the sizes of the notches 125 and peak portions 127 can be the same or in some embodiments, the sizes can vary along the outer peripheral edge of the second layer 120. As illustrated, the notches 125 and peaks 127 are formed along the two side edges and the top edge but are absent along the bottom edge of the second layer 120.

Along the inner surface of the first layer 110 is a first adhesive layer. This first adhesive layer is located at least within specified areas of the peripheral section 116 since the inner section 114 represents and defines a pocket in which the user's hand is placed. The first adhesive layer is formed of any number of suitable adhesives and in particular, can be a heat seal adhesive.

As described herein, a fluid reservoir 101 (FIG. 6) is located between the first layer 110 and the second layer 120 and it is within this fluid reservoir that the fluid to be dispensed is stored. The fluid reservoir 101 is a sealed compartment in which the fluid is held before dispensing. The volume of the fluid reservoir 101 can vary depending upon the size of the mitt 100. In one embodiment, the fluid reservoir 101 has a volume of about 100 ml; however, this value is merely exemplary and not limiting. As described herein the fluid reservoir 101 is in fluid communication with the pump subassembly 200 to allow fluid within the fluid reservoir 101 to be drawn into the pump subassembly 200 and then subsequently expelled from the pump subassembly 200. The volume of the fluid reservoir 101 and the dose volume of the pump subassembly 200 permit many individual doses to be obtained from the total volume of fluid contained in the reservoir 101. For example, when the fluid is a sunscreen lotion, the system 100 can provide many days, such as 10 days or more, of multi dosing (multiple applications each day).

The third layer 130 (the foam layer) has a similar footprint compared to the first layer 110 and the second layer 120 to allow all three layers to be superimposed to form the assembled product 100. The foam layer 130 can be a layer of closed cell foam, such as cross linked polyethylene.

The third layer 130, which represents the foam layer, has a first corner 132 that is superimposed with the first corners 112, 122. The third layer 130 has an inner surface or face that faces the second layer 120 and opposite outer surface or face that faces away from the second layer 120. The third layer 130 includes an inner section 134 and a peripheral section 136 that surrounds the inner section 134.

Figure 6:
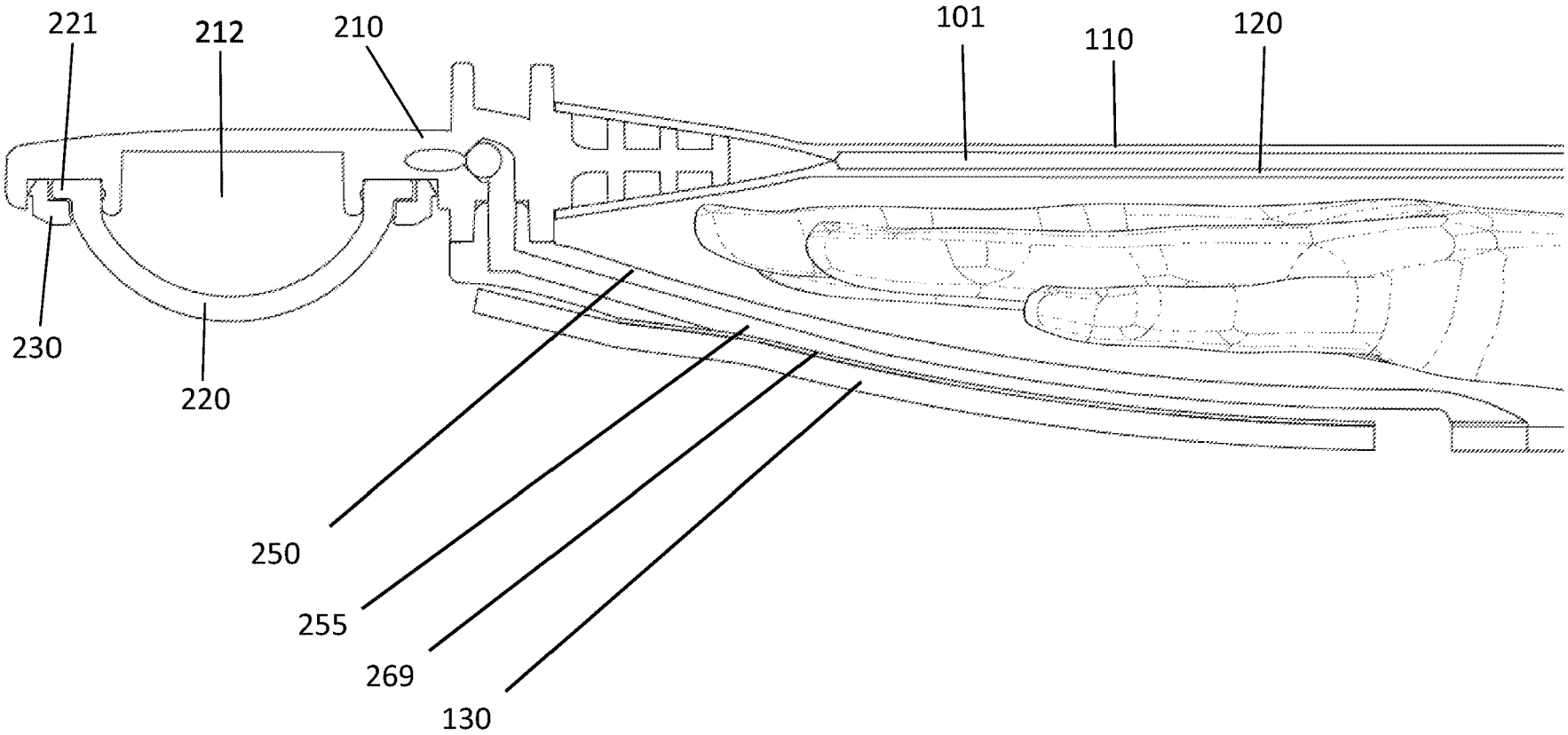
FIG. 6 is another cross-sectional view of the fitment pump and the outlet tube.

As described herein, the compartment that receives the user's hand is located between the second layer 120 and the third layer 130 (as shown in FIG. 6). The user's hand is thus in contact with the inner face of the foam layer 130.

To assemble the layered body of the system 100, the three layers 110, 120, 130 are superimposed with the second layer 120 being located between the first layer 110 and the third layer 130. Both the second and third layers 120, 130 are selectively joined (attached) to the first layer 110 by select contact between the first adhesive layer and the second and third layers 120, 130. In particular, the peak portions 127 of the second layer 120 are placed into contact with the first adhesive layer, thereby joining the second layer 120 to the first layer 110. The notches 125 provides windows that allow the peripheral section 136 of the third layer 130 to be placed into contact with the first adhesive layer formed on the inner surface of the first layer 110. In this way, the first adhesive layer can be used to attach the foam (third) layer 130 to the first layer 110 as well as attaching the second layer 120 to the first layer 110. The notches 125 thus provide discrete windows for allowing select contact between the foam layer 130 and the first layer 110.

In will also be appreciated that an inner surface of the foam layer 130 can include a second adhesive layer to provide additional strength, friction with the hand, and adhesion to the first adhesive layer (heat seal layer) of the first layer 110. For example, the second adhesive layer can be located in select locations of the peripheral section 136 of the third layer 130 to allow for contact with both one face of the peak portions 127 to bond the third layer 130 to the second layer 120 and also bond the third layer 130 to the first layer 110. Within the notches 125, the first and second adhesive layers can come into contact to ensure proper adhesion between these two layers 110, 130.

The second adhesive layer can be in the form of a layer of ethylene vinyl acetate (EVA) or EVA co-polymer and can be coated or laminated onto the upper surface (inner face) of the foam layer 130. The thickness of the second adhesive layer can, in one embodiment, be between about 25 microns to about 150 microns and more preferably, between about 50 microns and about 75 microns.

As shown in FIGS. 2 and 3, the foam layer 130 has a through hole 135 formed therein. The through hole 135 is not centrally located but instead is located closer to one end (e.g., a top edge) of the foam layer 130. The through hole 135 is shown as a circular shaped; however, this shape is merely exemplary and the through hole 135 can have other shapes.

The above described process is thus an effective manner of joining the three layers 110, 120, 130 in select, discrete locations to form an assembled three-ply mitt construction. The provision of the notches 125 along the periphery of the second layer 120 is an improved technique for limiting the number of bonding steps that are needed for bonding the three layers 110, 120, 130 together and also limits the amount of adhesive that is needed to achieve such bonding.

As mentioned, the system 100 includes the pump subassembly 200 that is configured to selectively dispense a metered amount of fluid. The pump subassembly 200 is disposed partially between the various layers of the system 100. The pump subassembly 200 is attached to the layered structure (pouch) in such a way that selective fluid communication is allowed between a substantially enclosed reservoir of fluid within the system 100 (which, as a mentioned, takes the form of a mitt or pouch) and at least one port accessing the face of the mitt. As described below, the pump subassembly 200 includes a displaceable interface, such as a deformable elastic membrane, so that a user may actively dispense fluid to the external face of the mitt (system 100) and more particularly, to the outer (external) face of the foam layer 130 since the foam layer 130 is the layer at which the fluid is dispensed.

The pump subassembly 200 is in the form of a fitment pump. The fitment pump 200 has a main body 210 that has a well 212 defined therein. The main body 210 also has a first end 214 that represents the exposed end that is located within the corner of the layered structure and an opposite second end 216 that faces toward the interior of the layered structure of the system 100. The fitment pump 200 also includes a pump bubble 220 and optionally includes a retaining ring 230. The pump bubble 220 has a convex shape and can be made of an elastomer, such as an olefin based thermoplastic elastomer. A hardness of Shore 80 A is one preferred value for the material that forms the pump bubble 220. The retaining ring 230 is configured to hold the pump bubble 220 to the main body 210. The retaining ring 230 can be eliminated.

Figure 4:
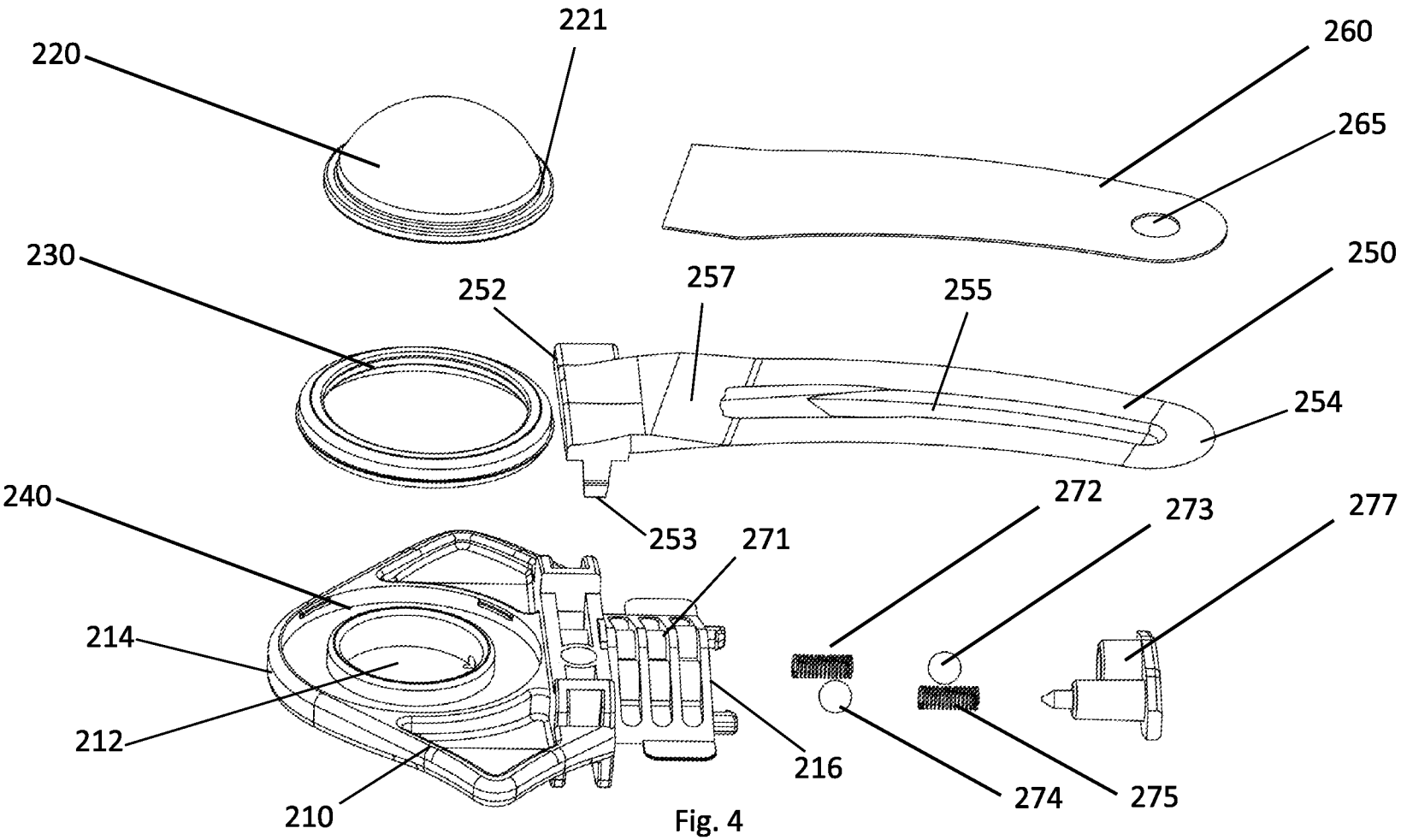
FIG. 4 is an exploded perspective view of a fitment pump.
Figure 5:
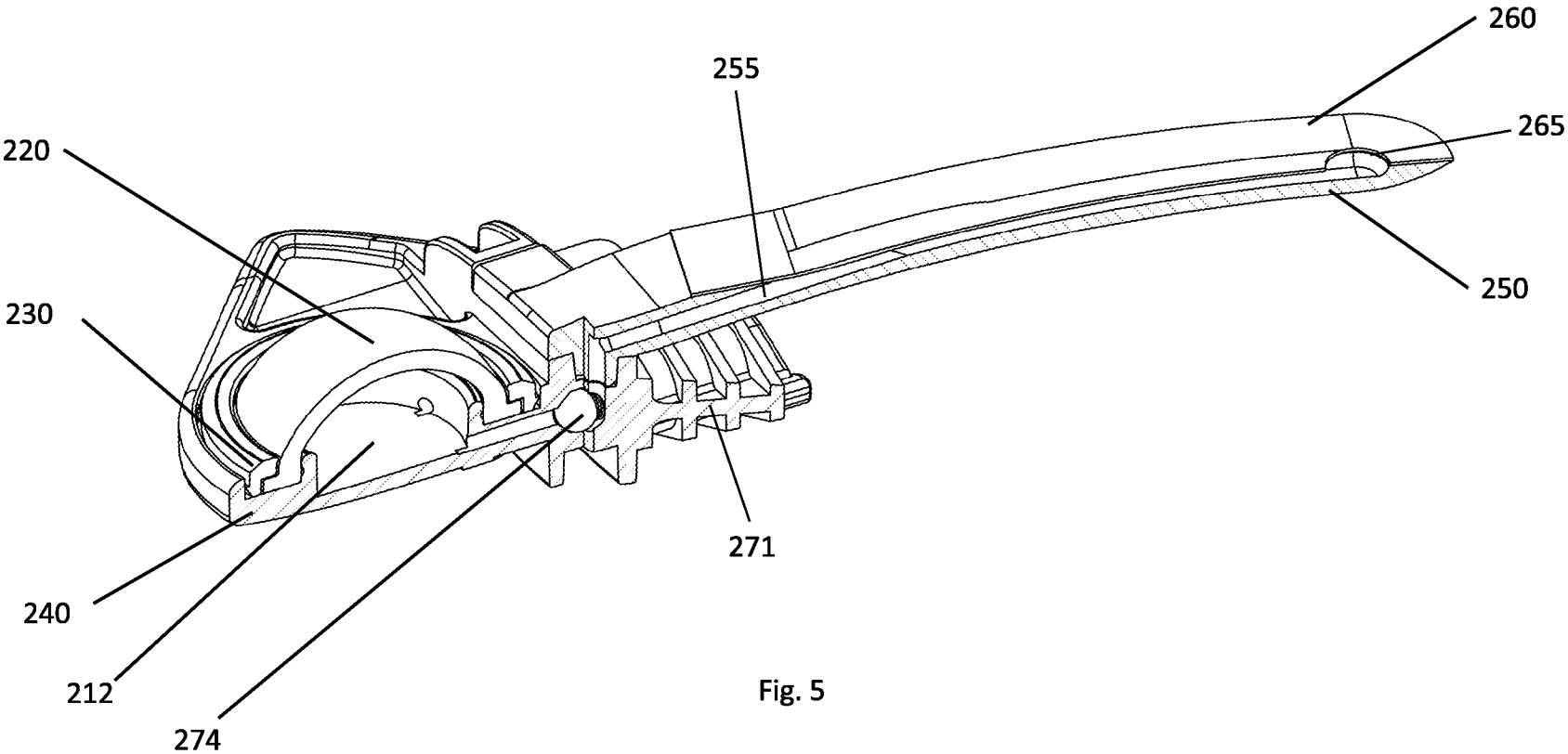
FIG. 5 is a cross-sectional view of an outlet tube and different layers of the fluid application system.

As shown in FIGS. 4 and 5, the main body 210 includes a seat 240 for the pump bubble 220. The seat 240 is an annular seat that is formed around the recessed portion 212 which can be considered to have a well shape. The pump bubble 220 has an outer (peripheral) flange or lip 221. The retaining ring 230, when used, is designed to be disposed over the lip 221 and in particular, a first section 232 of the ring seats on top of the lip 221 and a second section 234 engages the seat 240 effectively holding the lip 221 within the seat 240 and thereby coupling the pump bubble 220 to the main body 210.

It will also be appreciated that the main body 210 of the pump must be made of a material that is compatible with the heat seal layer of the layered structure. For example, the main body 210 can be formed of high density polyethylene or alternatively can be formed of polypropylene.

As described herein, the well 212 is designed to receive from the reservoir (storage compartment) 101 a quantity (dosing volume) of the fluid to be dispensed. The pump subassembly 200 is designed to draw in a dose of fluid from the storage compartment (reservoir) 101 and then expel it along a dispensing channel. The pump bubble 220 is disposed over the well 212 and thus the dose volume can be defined as the volume of the well 212 itself as well as the volume underneath the pump bubble 220.

The main body 210 includes a valve section 270 including a valve housing 271 which controls fluid flow into and out of the main body 210. The valve housing 271 is an extension that defines the second end 216 of the main body 210. The valve housing 271 is in fluid communication with the well 212 to allow fluid to be drawn into the well 212 from the reservoir 101 through an inlet conduit formed in the valve housing 271 and likewise, the valve housing 271 allows the dose volume captured within the well 212 to be discharged through an outlet conduit formed in the valve housing 271.

As shown in the cross-sectional view of FIG. 6, both the first and second layers 110, 120 are joined to the main body 210. The pump subassembly 200 is disposed within the contoured first corners 112, 122 of the first and second layers 110, 120, with the first and second layers 110, 120 being disposed against the valve housing 271 (i.e., the first and second layers 110, 120 can be heat sealed to the valve housing 271). As mentioned, these corners 112, 122 are contoured to receive the pump subassembly 200 and position it relative to the fluid reservoir 101.

More specifically, the pump subassembly 200 also includes a small set of functional elements that are entrapped or otherwise during assembly, including intake check ball 272, intake check spring 273, discharge check ball 274, and outlet check spring 275. The fluid delivery path provided by the pump subassembly terminates at a dispensing tube/outlet tube 250. A sealing coupling 277 is also provided and includes an inlet that is in fluid communication with the reservoir 101 and a fluid outlet that is in fluid communication with the dispensing tube 250. In a first operating state when fluid is drawn into the pump subassembly 200, the pump bubble is depressed to generate negative pressure that causes the intake check wall 272 to move off of a seat and allow fluid from the reservoir to flow through the valve housing 271 into the well 212. Similarly, when the well 212 is full and the user presses down on the pump bubble, the fluid contained within the well 212 is ejected causing the intake check ball 272 to close and the outlet check ball 274 opens and the ejected fluid flows through the valve housing 271 into the dispensing channel formed in the outlet tube 250.

The dispensing tube/outlet tube 250 that is configured to be coupled to the main body 210. For example, the outlet tube 250 can be configured to snapped into the main body 210 to retain the outlet tube 250 to the main body 210. The outlet tube 250 is an elongated structure that has a first end 252 (proximal end) and an opposite second end 254 (distal end). At the first end 252 there can be a pair of locking tabs 253 that engage complementary slots in the main body 210 for locking the outlet tube 250 in place relative to the main body 210. Within the outlet tube 250, a fluid channel 255 is defined and is constructed to allow fluid to flow along a length of the outlet tube 250. Fluid flows from the first end 252 to the second end 254.

A cover 260 is disposed over one face 257 of the outlet tube 250 for covering the fluid channel 255. The cover 260 thus is an elongated structure that has a complementary shape to the outlet tube 250. As shown in FIG. 4, the cover 260 has an opening 265 through which the fluid is discharged as described herein. The cover 260 can be in the form of a double sided adhesive film that acts to not only cover the fluid channel 255 but also attaches the outlet tube 250 to the inside surface of the foam layer 130 of the system (mitt/glove) 100. In one embodiment, a film, such as 3M 9474LE, that consists of a polyester middle layer with a low surface energy acrylic adhesive on both sides of the film, can be used as the outlet tube 250 for adhering to both the outlet tube 250 and the foam layer 130. Fluid that flows along the fluid channel 255 flows to the opening 265 where the fluid is discharged and flows to the foam layer 130 as described herein. As shown, the opening 265 can be located at or near one end of the fluid channel 255. When the cover 260 is adhered to the inner surface of the foam layer, the opening 265 of the cover 260 is aligned with the opening 135 formed in the foam layer 130 to allow the dosed fluid to be discharged through the opening 135.

FIG. 6 shows a first adhesive layer 269 that can be part of the cover 260 for attaching the cover 260 to the foam layer 130, thereby attaching the outlet tube 250 to the foam layer 130. As shown in FIG. 6, the foam layer 130 is adhered to an adhesive layer that is part of the cover 260 for securing the outlet tube 250 to the foam layer 130. When the user's hand is inserted into the system 100, the outlet tube 250 feels like it is part of the foam layer 130. FIG. 6 depicts fingers of the hand within the hand compartment formed between the foam layer 130 and the bottom layer 120. To dispense the fluid, the user simply uses his or her other hand to squeeze the pump subassembly 200 and thereby dispense one or more doses to the outer surface of the foam layer 130. In the case of dispensing a sunscreen lotion, the sunscreen lotion is dispensed through the opening 135 of the foam layer 130 onto the skin of the user. The user can then spread the sunscreen lotion using the foam layer 130. In other word, the foam layer 130 can be used to scrub the sunscreen lotion onto the skin of the user, thereby effectively covering the body part with the sunscreen lotion. To cover another body part, the user simply presses the pump subassembly 200 to dispense another dose through the opening 135 of the foam layer 130. The process is then repeated to effectively spread the sunscreen lotion.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A portable fluid dispensing device for mounting upon a human hand and for dispensing a fluid comprising:

a hand-held applicator that includes a pocket that is configured to receive one hand of a user, the pocket partitioning the hand-held applicator into a rear portion and a front portion, wherein the rear portion includes a fluid reservoir for holding a fluid that is to be dispensed; the rear portion including a first layer and a second layer that are fluidly sealed to one another at select locations such that the fluid reservoir is formed between the first and second layers, wherein the second layer has a plurality of open peripheral notches formed along a peripheral edge thereof so as to provide direct access points between the first layer and a third layer that defines the front portion, with the pocket being defined between the second and third layers, wherein the first and third layers are directly attached to one another at locations that lie within the peripheral notches of the second layer, wherein the third layer includes a dispensing hole through which the fluid is dispensed; and a pump subassembly that is in fluid communication with the fluid reservoir and includes an elongated fluid dispensing outlet that is disposed within the pocket and attached to an inner surface of the third layer, the fluid dispensing outlet defining a fluid channel and including an outlet that is aligned with the dispensing hole.

2. The portable fluid dispensing device of claim 1, wherein the second layer is a separate layer from the first layer and further defines one layer and one face of the pocket.

3. The portable fluid dispensing device of claim 1, wherein the peripheral notches are formed along first and second opposing sides of the second layer and along a top edge of the second layer, while a bottom edge of the second layer is free of peripheral notches.

4. The portable fluid dispensing device of claim 1, wherein the fluid comprises one of a liquid and a lotion.

5. The portable fluid dispensing device of claim 1, wherein the third layer comprises a foam layer.

6. The portable fluid dispensing device of claim 1, wherein the pump subassembly includes a valve manifold that is at least partially disposed between the first layer and the second layer and includes an inlet that is in fluid communication with the reservoir for drawing fluid from the reservoir into the pump subassembly.

7. The portable fluid dispensing device of claim 6, wherein the valve manifold includes an outlet that is in fluid communication with the elongated fluid dispensing outlet, the inlet including a first valve and the outlet including a second valve.

8. The portable fluid dispensing device of claim 1, wherein the pump subassembly includes a main body with a well defined therein and a pump bubble that covers the well and is coupled to the main body, wherein the elongated fluid dispensing outlet includes a base that has the fluid channel defined therein, one end of the fluid channel being in fluid communication with the well, the elongated fluid dispensing outlet further including a cover that is adhered to the base and covers the fluid channel, the cover including a hole that defines the outlet through which the fluid is discharged.

9. The portable fluid dispensing device of claim 8, wherein the cover has a first adhesive layer formed along a first surface thereof and a second adhesive layer formed along a second layer thereof, the first adhesive layer adhering the cover to the base such that the cover is disposed over the fluid channel, the second adhesive layer adhering the elongated fluid dispensing outlet to an inner surface of the third layer which comprises a foam layer.

10. The portable fluid dispensing device of claim 9, wherein the hole in the cover is disposed at a distal end of the fluid channel.

11. The portable fluid dispensing device of claim 8, wherein the pump subassembly includes a valve manifold that is at least partially disposed between the first layer and the second layer and includes an inlet that is in fluid communication with the reservoir for drawing fluid from the reservoir into the pump subassembly, the valve manifold including an outlet that is in fluid communication with the fluid channel formed in the base, the inlet including a first valve and the outlet including a second valve.

12. The portable fluid dispensing device of claim 8, wherein the main body includes an annular shaped seat which receives a peripheral lip of the pump bubble and surrounds the well.

13. The portable fluid dispensing device of claim 12, further including a retaining ring that is disposed within the annular shaped seat for locking the pump bubble to the main body.

14. The portable fluid dispensing device of claim 8, wherein the elongated fluid dispensing outlet has locking tabs at one end for interlockingly attaching the elongated fluid dispensing outlet to the main body.

15. A portable fluid dispensing device for mounting upon a human hand and for dispensing a fluid comprising:

a hand-held applicator that includes a pocket that is configured to receive one hand of a user, the pocket partitioning the hand-held applicator into a rear portion and a front portion, wherein the rear portion includes a fluid reservoir for holding a fluid that is to be dispensed; the rear portion including a first layer and a second layer that are fluidly sealed to one another such that the fluid reservoir is formed between the first and second layers, the front portion being defined by a foam layer that has a dispensing hole, with the pocket being defined between the second layer and the foam layer; and a pump subassembly that is in fluid communication with the fluid reservoir and includes an elongated fluid dispensing outlet that is disposed within the pocket and attached to an inner surface of the foam layer, the fluid dispensing outlet defining a fluid channel and including an outlet that is aligned with the dispensing hole for delivering the fluid to an outer surface of the foam layer.

16. A portable fluid dispensing device for mounting upon a human hand and for dispensing a fluid comprising:

a hand-held applicator that includes a pocket that is configured to receive one hand of a user, the pocket partitioning the hand-held applicator into a rear portion and a front portion, wherein the rear portion includes a fluid reservoir for holding a fluid that is to be dispensed; the rear portion including a first layer and a second layer that are fluidly sealed to one another such that the fluid reservoir is formed between the first and second layers, the front portion being defined by a foam layer that has a dispensing hole, with the pocket being defined between the second layer and the foam layer; and a pump subassembly that is in fluid communication with the fluid reservoir and includes an elongated fluid dispensing outlet that is disposed within the pocket and attached to an inner surface of the foam layer, the elongated fluid dispensing outlet having a base that has an elongated fluid channel defined therein and a second part in the form of a cover that is disposed over one face of the base covering the elongated fluid channel, the cover including an outlet hole that is aligned with the dispensing hole for delivering the fluid to an outer surface of the foam layer, wherein the cover comprises a double sided adhesive film that acts to not only cover the elongated fluid channel by being adhesively adhered to the one face of the base but also attaches the elongated fluid dispensing outlet to an inside surface of the foam layer.

* * * * *